US011728113B2

(12) United States Patent
Papillon et al.

(10) Patent No.: US 11,728,113 B2
(45) Date of Patent: Aug. 15, 2023

(54) ELECTRICAL BREAKING CONTACT

(71) Applicant: Schneider Electric Industries SAS, Rueil Malmaison (FR)

(72) Inventors: Anthony Papillon, Proveysieux (FR); Mathieu Bono, Miribel Lanchâtre (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 17/551,256

(22) Filed: Dec. 15, 2021

(65) Prior Publication Data

US 2022/0199342 A1 Jun. 23, 2022

(30) Foreign Application Priority Data

Dec. 23, 2020 (FR) ..... FR2014058

(51) Int. Cl.

| | |
|---|---|
| ***H01H 33/02*** | (2006.01) |
| ***H01H 33/664*** | (2006.01) |
| ***H01H 33/662*** | (2006.01) |
| ***H01H 33/666*** | (2006.01) |

(52) U.S. Cl.

CPC ..... *H01H 33/6643* (2013.01); *H01H 33/025* (2013.01); *H01H 33/6664* (2013.01); *H01H 2033/66246* (2013.01)

(58) Field of Classification Search

CPC ..... H01H 33/6643; H01H 33/6664; H01H 33/664; H01H 33/025; H01H 33/6644; H01H 2033/66246; H01H 2033/6648; H01H 1/50; H01H 33/66

USPC ..... 218/118, 123, 127, 128, 129, 146

See application file for complete search history.

(56) References Cited

U.S. PATENT DOCUMENTS

| | | | | |
|---|---|---|---|---|
| 4,440,995 | A | 4/1984 | Lange et al. | |
| 6,541,726 | B2 * | 4/2003 | Schellekens | H01H 1/62 218/123 |
| 7,906,742 | B2 * | 3/2011 | Steffens | H01H 33/6642 218/123 |
| 8,039,771 | B2 * | 10/2011 | Trondsen | H01H 33/66261 218/136 |

(Continued)

FOREIGN PATENT DOCUMENTS

| | | |
|---|---|---|
| CN | 203774164 U | 8/2014 |
| CN | 203774165 U | 8/2014 |

OTHER PUBLICATIONS

French Search Report and Written Opnion dated Sep. 7, 2021 for corresponding French Patent Application No. FR2014058, 15 pages.

*Primary Examiner* — William A Bolton
(74) *Attorney, Agent, or Firm* — Locke Lord LLP

(57) ABSTRACT

An electrical breaking contact, in particular a radial-magnetic-field electrical breaking contact, is provided for a medium-voltage vacuum interrupter, the contact including:
a rod extending along a longitudinal axis, said rod being configured to be passed through by an electrical current,
a contact body extending transversely to the longitudinal axis and including a first fastening surface, the contact body and the rod being coaxial,
wherein the rod includes:
a second fastening surface securely fastened to the first fastening surface,
an abutment surface radially exterior to the first fastening surface (4), the abutment surface being distant from the contact body along the longitudinal axis and turned toward the contact body.

13 Claims, 6 Drawing Sheets

(56) References Cited

U.S. PATENT DOCUMENTS

| | | | | |
|---|---|---|---|---|
| 8,426,754 | B2 * | 4/2013 | Kikuchi | H01H 33/6643 200/269 |
| 8,653,397 | B2 * | 2/2014 | Yang | H01H 33/664 218/143 |
| 9,552,941 | B1 | 1/2017 | Li et al. | |
| 9,613,769 | B2 * | 4/2017 | Gentsch | H01H 33/6642 |
| 2014/0048514 | A1 * | 2/2014 | Balasubramanian | H01H 33/6643 218/123 |

* cited by examiner

ELECTRICAL BREAKING CONTACT

TECHNICAL FIELD

The present invention relates to the field of the medium-voltage vacuum breaking devices also called vacuum interrupters. Vacuum interrupters are used in electrical devices for distributing medium voltages, i.e. voltages from 1 to 52 kV. Vacuum interrupters are associated with actuators with a view to breaking the current in one portion of the circuit.

PRIOR ART

As is well known, a vacuum interrupter comprises two breaking contacts placed facing. Each breaking contact comprises a rod for conducting electrical current, and a contact body securely fastened to the rod. The contacts are placed in a jacket forming a seal-tight enclosure placed under vacuum. The contacts may be moved with respect to each other.

When the contacts are in abutment with each other, the current may pass from one contact to the other. When the contacts are separated from each other, the current is broken.

An electric arc is generated both when the current is broken and when it is established. The formed electric arc heats the parts through which the arc passes, and may cause the surface of the contacts to melt locally. It is thus known to give the contacts a shape such that the electric arc thus created generates a radial magnetic field, this allowing the arc to be oriented favourably and in the end to control it. The invention described here more particularly relates to this type of radial-magnetic-field contacts, which are also known as RMF or TMF contacts, RMF standing for radial magnetic field and TMF standing for transverse magnetic field. However, the invention could optionally be applied to other types of contacts.

The aim of the present invention is to improve the performance of this type of vacuum interrupter.

On closure of the vacuum interrupter, the relative speed between the contacts at the moment at which said contacts reach abutment with each other tends to cause a rebound effect. In other words, continuity between the contacts does not occur abruptly, and the distance between the electrical contacts tends to oscillate. According to certain international or national standards, in particular the standard CN GB 50150-2016, the duration of the rebound must remain shorter than a certain limit, which is for example equal to 2 or 3 milliseconds. It would therefore be advantageous to provide a solution allowing the duration of these rebounds to be minimized.

SUMMARY

To this end, the invention provides an electrical breaking contact, in particular a radial-magnetic-field electrical breaking contact, for a medium-voltage vacuum interrupter, the contact comprising:

a rod extending along a longitudinal axis, said rod being configured to be passed through by an electrical current, a contact body extending transversely to the longitudinal axis and comprising a first fastening surface, the contact body and the rod being coaxial, wherein the rod comprises:

a second fastening surface securely fastened to the first fastening surface, an abutment surface radially exterior to the second fastening surface, the abutment surface being distant from the contact body along the longitudinal axis and turned toward the contact body.

In other words, in the provided electrical breaking contact, the contact body and the abutment surface are configured so that the contact body is able to make a flexural movement in a direction parallel to the longitudinal axis.

The contact body and the abutment surface are configured so that one segment or portion of the contact body makes contact with the abutment surface during a flexion of the contact body.

Conventionally, on closure of the electrical circuits of the vacuum interrupter, i.e. when the movable contact of the vacuum interrupter touches the fixed contact, a shock occurs that tends to create a rebound. In other words, after the initial shock the two contacts may separate again slightly, this promoting re-striking of the electric arc. This rebound effect is to be avoided. According to the invention, the abutment surface of the rod, which is radially exterior to the region in which the rod and the contact body are securely fastened, is set back with respect to the contact body. Thus, the contact body is configured to flex when, on closure of the vacuum interrupter, the contact body impacts a second contact body placed facing. This deformation by deflection of the contact body contributes to dissipation of the energy of the impact with the second electrical contact, and thus to limitation of the rebound effect.

The features listed in the following paragraphs may be implemented independently of one another or in any technically possible combination:

The rod and the contact body are electrically conductive. The rod and the contact body are made of metal.

The contact body is disc-shaped. The rod is cylindrical.

The contact body is configured to make contact with at least one portion of the abutment surface during a flexion of the contact body.

The first fastening surface and the second fastening surface are perpendicular to the longitudinal axis.

The second fastening surface is formed by a shoulder of the rod.

The first fastening surface and the second fastening surface are securely fastened via a braze.

According to one embodiment of the electrical breaking contact, a distance, measured in a direction parallel to the longitudinal axis, between the abutment surface and the contact body, is comprised between 0.2 millimetres and 1.0 millimetres.

This value of the axial play between the abutment surface and the contact body allows a deflection amplitude that is well suited to the energy to be dissipated during the shock between the electrical contacts.

According to one embodiment of the electrical breaking contact, the abutment surface comprises a plurality of abutment regions that are distant from one another.

The abutment surface comprises four abutment regions.

At least one abutment region extends from an exterior edge of the rod in the direction of the longitudinal axis of the rod.

At least one abutment region comprises an annular segment extending radially between a first distance from the longitudinal axis and a second distance from the longitudinal axis. The first distance is smaller than or equal to the value of the radius of the rod. The second distance is larger than the value of the radius of the second fastening surface.

The annular segment of the abutment region occupies an angular sector of angular value comprised between 15° and 45°.

The abutment surface is planar. As a variant, the abutment surface has a frustoconical shape.

The abutment surface and the fastening surface lie in parallel planes.

According to one aspect of the invention, the rod comprises a groove adjacent to the second fastening surface.

When the rod and the contact body have been securely fastened by brazing, the groove makes it possible to avoid a capillary effect that could lead to a migration of the brazing material from the first fastening surface to the abutment surface.

At least one abutment region is adjacent to one segment of the groove.

According to another aspect of the invention, the contact body comprises a contact surface configured to make contact with a second electrical breaking contact placed facing the contact, so as to allow an electrical current to pass between the two contacts, the first fastening surface extends radially between a first internal distance and a first external distance, and the contact surface extends radially between a second internal distance and a second external distance, and a ratio between the second internal distance and the first external distance is higher than or equal to 1.

In other words, when the ratio is higher than 1, the contact surface is radially exterior to the first fastening surface.

On closure of the vacuum interrupter, the electrical field increases as the contacts get closer to each other, until dielectric breakdown occurs. The dielectric breakdown causes an electric arc to appear between the contacts just before they make mechanical contact. Surface melting caused by the electric arc often leads to local welds between the contacts. These welds increase the force required to reopen the vacuum interrupter. It would thus be desirable to provide a solution allowing the force required to break such welds to be limited.

By virtue of the relative arrangement of the first fastening surface and of the contact surface, the region of initiation of the electric arc is radially offset with respect to the centre of the contacts. This allows the electrodynamic forces applied to the initial arc to be increased and thus its speed of rotation to be increased. In this way, the arc is rapidly pushed out of the privileged region of mechanical contact, i.e. the region of initiation of the electric arc, thus avoiding welding of the contacts. Thus, the force required to reopen the contacts remains substantially constant during use.

The contact body comprises a thinned segment extending from the longitudinal axis.

The thinned segment may have a circular shape. The thinned segment may be obtained by producing a counterbore in the contact body, centred on the longitudinal axis. In other words, the contact body comprises a blind void centred on the longitudinal axis.

According to one embodiment of the electrical breaking contact, the abutment surface is plumb with the contact surface in a direction parallel to the longitudinal axis.

According to one example of implementation, the contact surface comprises a plurality of contact regions that are distant from one another.

This configuration allows a rapid movement of the arc in the initial breaking or pre-striking phase on closure to be promoted. This promotes both breaking performance and obtainment of the weakest possible weld of the contacts.

Each abutment region is located plumb with a contact region in a direction parallel to the longitudinal axis.

According to one embodiment, the contact body has a spiral configuration, the contact body having a disc shape comprising slits passing through the thickness of the disc, the slits extending from the periphery of the contact body toward the interior of the contact body 3.

This configuration allows the creation of a radial magnetic field when an electric arc is flowing between the breaking contacts to be promoted.

The contact body comprises branches, each branch being comprised between two consecutive slits.

The branches extend toward the exterior from a central portion, and comprise a curved edge.

Purely illustratively, the slits are curved in the depicted embodiment. The slits make, level with the periphery of the disc, an angle comprised between 30° and 50° to the radial direction.

The slits extend between a first end that opens onto the periphery of the disc and a second end, and the slits make, at the second end, an angle comprised between 70° and 90° to the radial direction.

According to one embodiment of the electrical breaking contact, the contact body comprises a bevelled segment placed in a radial direction to the exterior of the contact surface.

This shape makes it possible to prevent the contact surface from being located on the periphery of the contact body. Thus, the moment of the force required to break any weld between the contacts is minimized. The risk of plastic deformation of the contact body during the application of a force allowing the contacts to be separated is decreased. The ability to open the vacuum interrupter is thus preserved.

The bevelled segment makes with the longitudinal axis an angle comprised between 80° and 89°.

The bevelled segment extends from a radially exterior edge of the contact surface to the periphery of the contact body.

According to one embodiment, the contact body comprises an angular positioning hole and the rod comprises an angular positioning pin, the pin being inserted into the angular positioning hole.

The invention also relates to a radial-magnetic-field electrical breaking contact for a medium-voltage vacuum interrupter, the contact comprising:

a rod extending along a longitudinal axis, said rod being configured to be passed through by an electrical current, a disc-shaped contact body that extends transversely to the longitudinal axis, the contact body and the rod being coaxial, the contact body comprising:

a first fastening surface securely fastened to the rod, and a contact surface configured to make contact with a second electrical breaking contact placed facing the contact, so as to allow a passage of electrical current between the two contacts, wherein the first fastening surface extends radially between a first internal distance and a first external distance, and the contact surface extends radially between a second internal distance and a second external distance, and wherein a ratio between the second internal distance and the first external distance is higher than 0.9 and preferably higher than 1.

The invention also relates to a vacuum interrupter comprising a fixed contact such as described above and a movable contact such as described above, the movable contact being movable between a position of contact with the fixed contact allowing a passage of electrical current and a position distant from the fixed contact preventing a passage of current.

BRIEF DESCRIPTION OF THE DRAWINGS

Other features, details and advantages will become apparent from reading the description provided below and from examining the appended drawings, in which.

DESCRIPTION OF THE EMBODIMENTS

For the sake of the legibility of the figures, the various elements have not necessarily been shown to scale. In the figures, elements that are identical have been designated with the same references. Certain elements or parameters may be indexed, i.e. designated for example by first element or second element, or even first parameter and second parameter, etc. The aim of this indexing is to differentiate between elements or parameters that are similar but not identical. This indexing does not imply that one element or parameter takes priority over another; it is possible to interchange the denominations. When it is specified that a subsystem comprises a given element, this does not exclude the presence of other elements in this subsystem.

Figure 1:
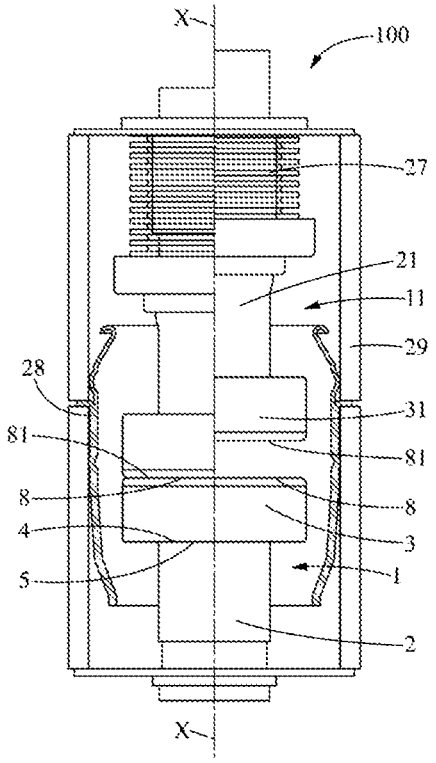
FIG. 1 is a schematic representation of a vacuum interrupter according to the prior art.

FIG. 1 shows a vacuum interrupter 100 comprising a fixed contact 1 that will be described below and a movable contact 11 that will also be described below. The movable contact 11 is placed facing the fixed contact 1. The two contacts 1, 11 are coaxial. The movable contact 11 is movable between a position of contact with the fixed contact 1 allowing a passage of electrical current, and a position in which the fixed contact 1 is distant preventing a passage of current. The left-hand half of FIG. 1 shows the contacts 1, 11 in contact position. The right-hand half of FIG. 1 shows the contacts 1, 11 positioned separate from each other, i.e. in the position in which the passage of current is interrupted. A control mechanism (not shown) allows the movable contact 11 to be moved so as to bring it into abutment with the fixed contact 1, and also allows it to be moved away in order to break the current. The vacuum interrupter 100 is intended for a device for breaking medium voltages, i.e. voltages comprised between 1 kV and 52 kV. The breaking device may for example be a circuit breaker, a disconnector or a switch. The vacuum interrupter 100 comprises a jacket 29, forming a seal-tight enclosure that is under vacuum. What is meant by that is that the pressure inside the enclosure is lower than $10^{-4}$ millibars. A shield 28 is placed facing the breaking contacts 1, 11 in a radial direction. A bellows 27 makes it possible to move the movable contact 11 while retaining seal-tightness.

The electrical breaking contact 1 comprises a rod 2 for conducting current and a contact body 3. The rod 2 and the contact body 3 are electrically conductive. The rod 2 and the contact body 3 are made of metal. In the same way, the second contact 11 comprises a rod 21 and a contact body 31. The two contacts 1, 11 are constructed in a similar way.

The rod 2 and the contact body 3 are securely fastened, i.e. they are rigidly attached to each other. To this end, the contact body 3 comprises a first fastening surface 4 and the rod 2 comprises a second fastening surface 5. The first fastening surface 4 and the second fastening surface 5 are here securely fastened via a braze. The first fastening surface 4 and the second fastening surface 5 are perpendicular to the longitudinal axis X.

Figure 2:
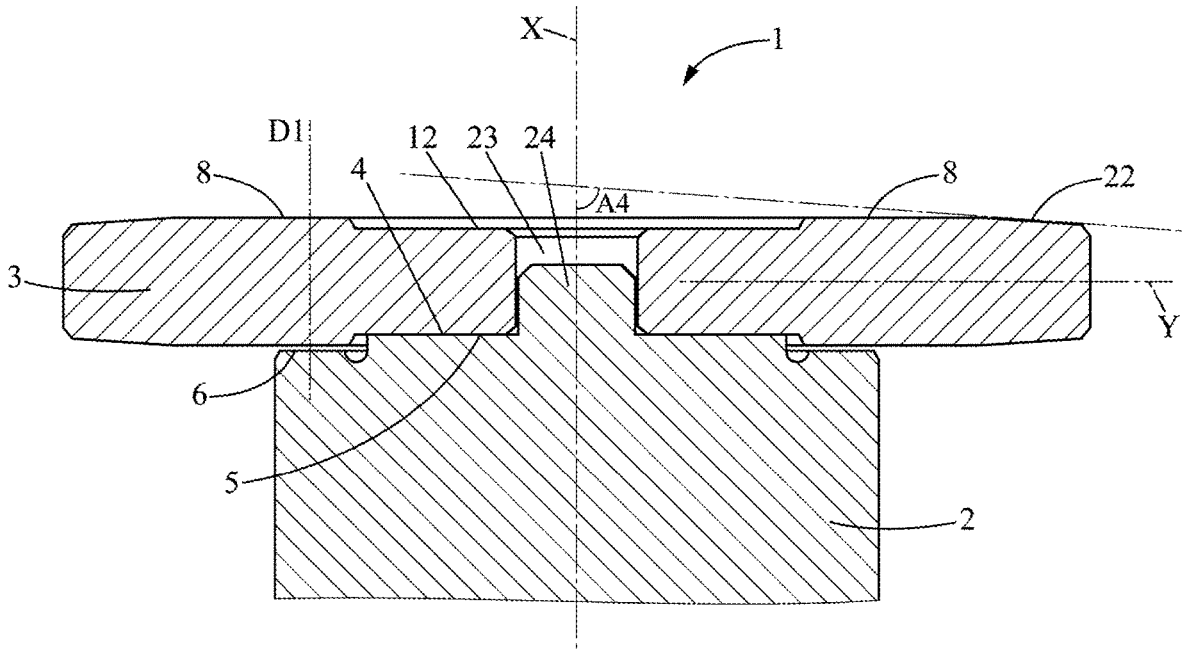
FIG. 2 is one schematic representation in cross section of an electrical breaking contact according to a first embodiment of the invention.
Figure 3:
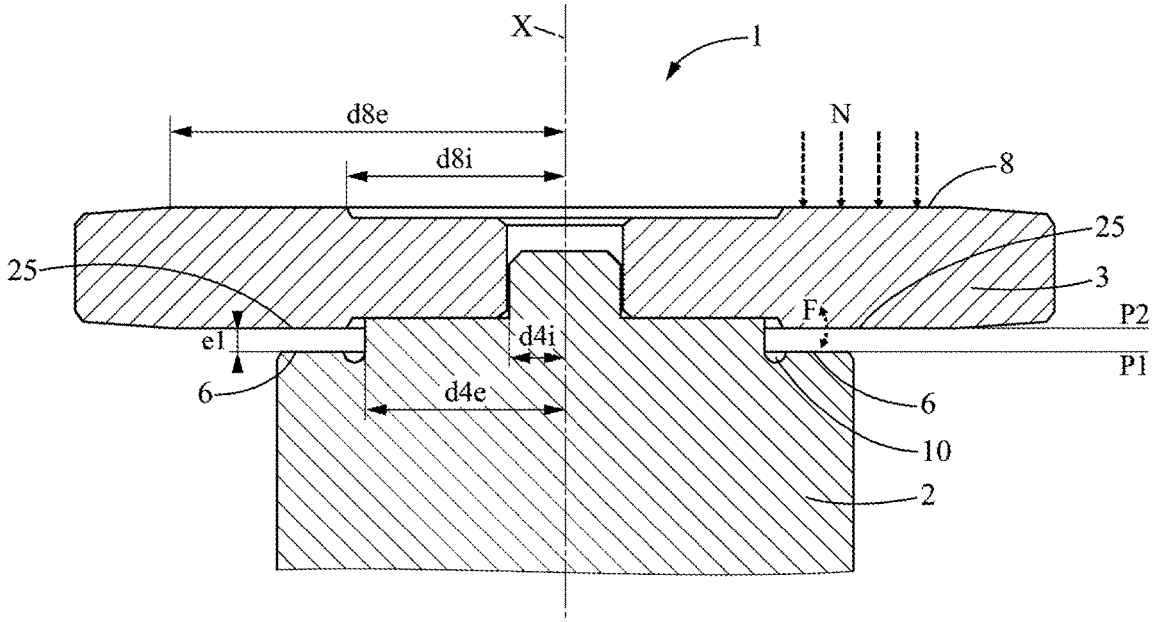
FIG. 3 is another schematic representation in cross section of the electrical breaking contact of FIG. 2.
Figure 4:
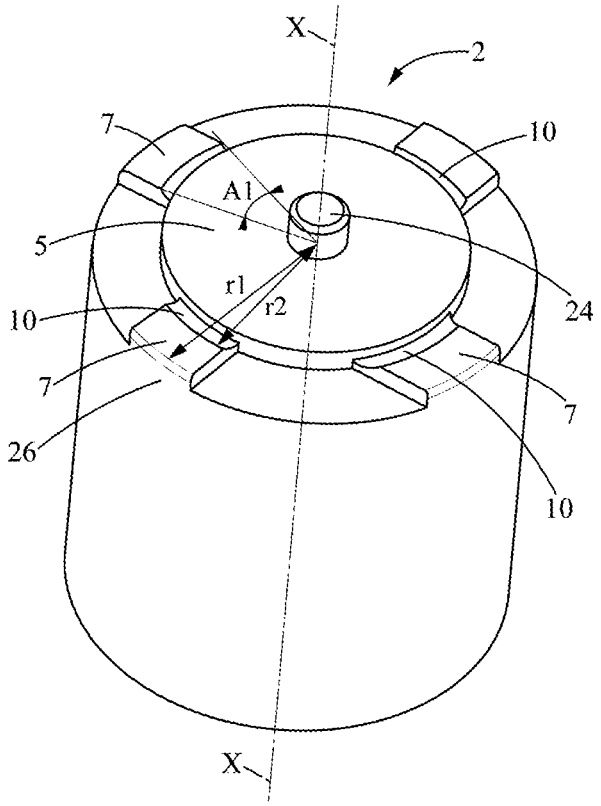
FIG. 4 is a detail view in perspective of the rod of the breaking contact of FIG. 2.

In the example illustrated in FIG. 1, the contact body 3 is disc-shaped. The rod 2 is cylindrical. In the embodiments of FIGS. 2 to 4, the second fastening surface 5 is formed by a shoulder of the rod 2.

The contact body 1 is configured so that an electric arc formed between the contact body 1 and the second contact body 11 generates a radial magnetic field. The electric arc in particular forms during establishment and/or breakage of the current, when the breaking contact 1 is sufficiently close to the second breaking contact 11. The potential difference between the facing contact bodies then creates an electric arc that traverses the space located between the two contacts 1, 11.

FIG. 2 shows an electrical breaking contact 1 for a medium-voltage vacuum interrupter 100, the contact 1 comprising:

a rod 2 extending along a longitudinal axis X, said rod being configured to be passed through by an electrical current, a contact body 3 extending transversely to the longitudinal axis X and comprising a first fastening surface 4, the contact body 3 and the rod 2 being coaxial, wherein the rod 2 comprises:

a second fastening surface 5 securely fastened to the first fastening surface 4, an abutment surface 6 radially exterior to the second fastening surface 5, the abutment surface 6 being distant from the contact body 3 along the longitudinal axis X and turned toward the contact body 3.

The electrical breaking contact 1 is here a radial-magnetic-field breaking contact. In the example in particular illustrated in FIG. 3, the distance e1, measured in a direction parallel to the longitudinal axis X, between the abutment surface 6 and the contact body 3, is comprised between 0.2 millimetres and 1.0 millimetres. In FIG. 3, the distance e1 has been exaggerated in order to be better seen.

By virtue of the distance e1, the contact body 3 and the abutment surface 6 are configured so that the contact body 3 is able to make a flexural movement, in particular in a direction parallel to the longitudinal axis X. The possible flexion has been depicted by the arrow F in FIG. 3.

On closure of the electrical circuit of the vacuum interrupter, i.e. when the control mechanism of the vacuum interrupter 100 causes the movable contact 11 to touch the fixed contact 1, a shock occurs that tends to create a rebound between the two contacts 1, 11. In other words, after the initial shock the two contacts 1, 11 may separate again slightly, this promoting re-striking of the electric arc. This rebound effect is to be avoided because it degrades the control of the formation of the electric arc. According to the invention, the abutment surface 6 of the rod 2 is set back with respect to the contact body 3. Thus, the contact body 3 may flex when, on closure of the vacuum interrupter, the contact body 3 impacts a second contact body 31 placed facing. This deformation by deflection of the contact body 3 contributes to dissipation of the energy of the impact with the second electrical contact, and thus to limitation of the rebound effect. The arrows N depict the force that is applied to the contact body when the contacts 1, 11 are in abutment with each other. The arrow F depicts the resultant flexion. The concept is here presented with a radial-magnetic-field electrical breaking contact 1. It may also be applied to other types of electrical breaking contact, and in particular an axial-magnetic-field electrical breaking contact.

Figure 7:
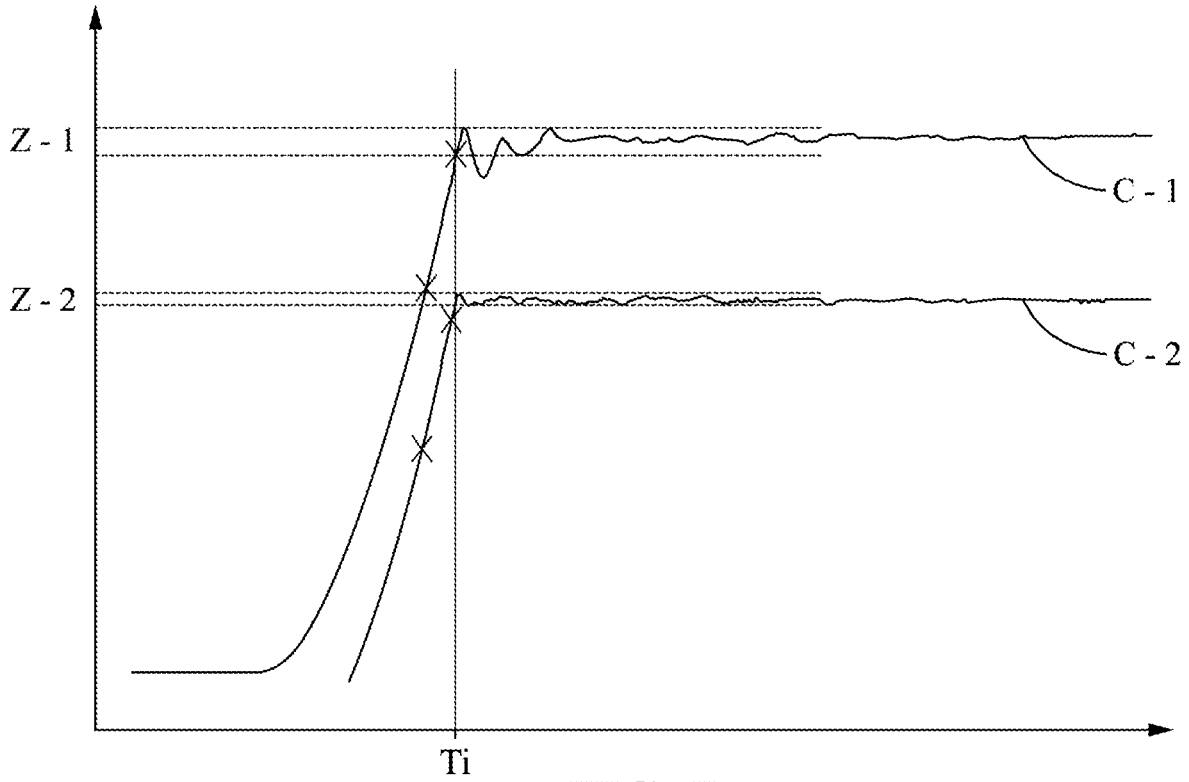
FIG. 7 is a curve of the variation as a function of time in the position of a breaking contact during closure of a vacuum interrupter.

In FIG. 7, the curve C-1 shows the variation as a function of time in the position of the movable breaking contact 11 during closure of a vacuum interrupter according to the prior art. The curve C-2 shows the variation as a function of time in the position of the movable breaking contact 11 during closure of a vacuum interrupter according to the invention. The time Ti indicates the time at which the movable contact 11 strikes the fixed contact 1. In the curve C-1, the rebound effect after the shock is clearly visible, and the parameter Z-1 indicates the amplitude of the rebound. In the curve C-2, it may be seen that the amplitude Z-2 of the rebound is clearly lower than Z-1, because of the dissipation of the energy of the shock via the flexion of the contact body and via the contact with the abutment surface of the rod. Other methods for characterizing rebounds may be employed, for example methods based on measurements of electrical signals.

The contact body 3 and the abutment surface 6 are also configured so that one segment 25 of the contact body 3 makes contact with the abutment surface 6 during a flexion of the contact body 3. More precisely, the contact body 3 is configured to make contact with at least one portion of the abutment surface 6 during a flexion of the contact body 3.

According to the embodiment of FIG. 4, the abutment surface 6 comprises a plurality of abutment regions 7 that are distant from one another. More precisely, the abutment surface 6 comprises four abutment regions 7.

At least one abutment region 7 extends from an exterior edge 26 of the rod 2 in the direction of the longitudinal axis X of the rod 2.

The abutment surface 6 is planar. The abutment surface 6 and the second fastening surface 5 lie in parallel planes P1, P2. According to one variant (not shown) the abutment surface 6 has a frustoconical shape.

At least one abutment region 7 comprises an annular segment extending radially between a first distance r1 from the longitudinal axis X and a second distance r2 from the longitudinal axis X. The first distance r1 is smaller than or equal to the value of the radius of the rod 2. The second distance r2 is larger than the value of the radius of the second fastening surface 5.

The annular segment of the abutment region 7 occupies an angular sector A1 of angular value comprised between 15° and 45°.

The rod 2 comprises a groove 10 adjacent to the second fastening surface 5. Thus, as may be more particularly seen in FIG. 2, when the rod 2 and the contact body 3 are brazed together, the groove 10 makes it possible to avoid a capillary effect that would lead to a migration of brazing material from the first fastening surface to the abutment surface. The brazing region is the gap comprised between the first fastening surface 4 of the contact body 3 and the second fastening surface 5 of the rod 2. At least one abutment region 7 is adjacent to one segment of the groove 10. In the example of FIG. 4, each abutment region 7 is bounded radially by a circular arc. The abutment region 7 is bounded in the radial direction by the groove 10, on the interior side, and by the periphery of the rod, on the exterior side. The width of the groove 10, measured in a transverse direction Y, is larger than 0.5 millimetres. The depth of the groove 10, measured in the longitudinal direction X, is larger than 0.5 millimetres.

According to another aspect of the invention, in particular illustrated in FIG. 3, the contact body 3 comprises a contact surface 8 configured to make contact with a second electrical breaking contact 11 placed facing the contact 1, so as to allow an electrical current to pass between the two contacts 1, 11, the first fastening surface 4 extends radially between a first internal distance d4*i* and a first external distance d4*e*, and the contact surface 8 extends radially between a second internal distance d8*i* and a second external distance d8*e*, and a ratio R between the second internal distance d8*i* and the first external distance d4*e* is higher than or equal to 1.

In other words, when the ratio R has value higher than 1, the contact surface 8 is radially exterior to the first fastening surface 4. In this case, the innermost point of the contact surface 8 is further from the longitudinal axis X than the outermost point of the first fastening surface 4.

Figure 6:
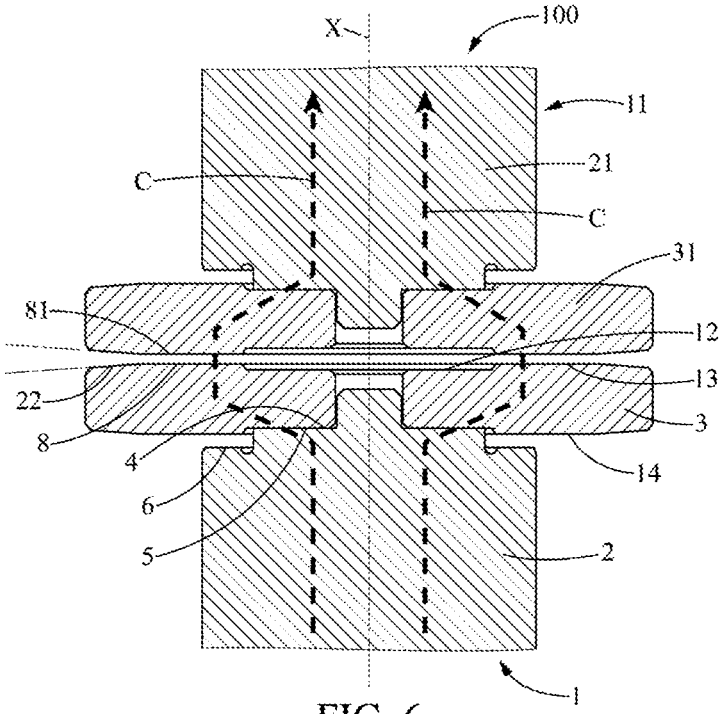

Thus, the contact surfaces 8, 81 through which contact is made between the breaking contacts 1, 11 are radially offset toward the exterior with respect to the current-conducting rods 2, 21. The passage of the electrical current has been depicted in FIG. 6 by the arrows C. The region through which the electrical current may transit is thus of greater extent than in the solutions according to the prior art. In addition, as the breaking contacts are of radial-magnetic-field type, the electric arc is deviated toward the exterior of the contacts. This configuration allows a better control of the electric arc between the contacts. In particular, this configuration allows the electrical contact region and the region through which the electric arc passes to be separated. The contact body 3 is here a radial-magnetic-field contact body.

The contact body 3 comprises a thinned segment 12 that extends from the longitudinal axis X. The thinned segment 12 may have a circular shape. The thinned segment 12 is here formed by a counter bore in the contact body, centred on the longitudinal axis X. The first fastening surface 4 and the contact surface 8 are located on opposite axial faces 13, 14 of the contact body 3.

In the example described here, as shown in FIG. 2, the abutment surface 6 is plumb with the contact surface 8 in a direction D1 parallel to the longitudinal axis X. What is meant by that is that any straight line D1 parallel to the longitudinal axis X and passing through the abutment surface 6 passes through the contact surface 8.

Figure 5:
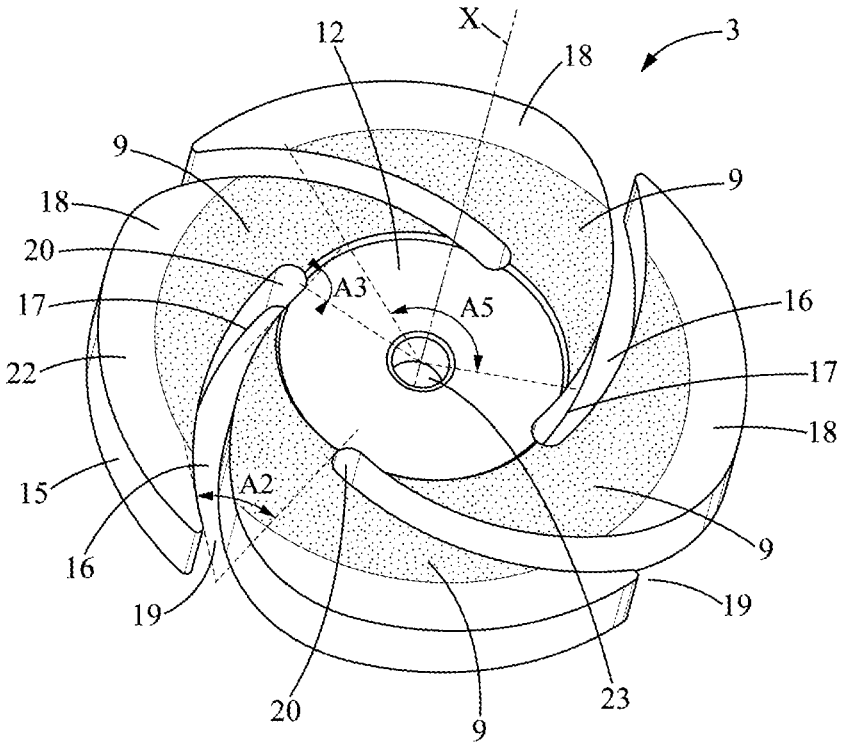
FIG. 5 is a detail view in perspective of a contact body according to a second embodiment of the invention, FIG. 6 schematically shows in cross section the operation of a vacuum interrupter incorporating electrical breaking contacts according to the invention.

FIG. 5 shows one embodiment of a contact body 3. In FIG. 5, the contact surface 8 comprises a plurality of contact regions 9 that are distant from one another. For the sake of the legibility of FIG. 5, the contact regions 9 have been emphasized with dots. According to variants that have not been shown, the contact surface 8 may be a single continuous segment. This is in particular the case when the thinned segment 12 has a diameter small enough to not extend radially as far as the slits 16.

Each abutment region 7 is located plumb with one contact region 9 in a direction parallel to the longitudinal axis X. As above, what is meant by that is that any straight line parallel to the longitudinal axis X and passing through an abutment region 7 passes through a contact surface 9. In other words, viewed along the longitudinal axis X, the perimeter of an abutment region 7 is inside the perimeter of a contact region 9.

In this example, the contact body 3 has a spiral configuration, the contact body 3 having a disc shape comprising slits 16 passing through the thickness of the disc, the slits 16 extending from the periphery 15 of the contact body 3 toward the interior of the contact body 3.

This configuration allows the creation of a radial magnetic field when an electric arc is flowing between the breaking contacts to be promoted.

The contact body comprises branches 18, each branch 18 being comprised between two consecutive slits. Each branch 18 is formed by material comprised angularly between two consecutive slits 16. The branches 18 extend toward the exterior from a central portion, and comprise a curved edge. According to variants that have not been shown, the branches 18 may have other shapes. More generally, the branches 18 may have any shape allowing the electric arc to generate a radial magnetic field. In the illustrated example, each contact body 3, 31 comprises four branches 18. The angular separation between two consecutive branches is constant, and equal to 90°. In variants that have not been shown, and in which the contact bodies 3, 31 possess a number of branches 18 different from four, the number of abutment regions 7 of the abutment surface 6 is equal to the number of branches 18 of the contact bodies 3, 31. Each branch 18 is plumb with one abutment region 7. More precisely, each abutment surface 7 is plumb with one contact region 9.

The contact regions 9 occupy an angular sector of angular value A5. The annular segment of the abutment region 7 occupies an angular sector of angular value A1 smaller than the angular value A5.

In the illustrated example, the slits 16 are curved. According to variants that have not been shown, the slits 16 may be rectilinear. The slits make, level with the periphery of the disc, an angle A2 comprised between 30° and 50° to the radial direction. The slits 16 extend between a first end 19 that opens onto the periphery of the disc and a second end 20, and the slits make, at the second end, an angle A3 comprised between 70° and 90° to the radial direction. The angle A2 of a slit 16 is measured at its edge furthest from the longitudinal axis X. The angle A3 of a slit 16 is measured at its edge closest to the longitudinal axis X.

As illustrated in FIG. 2, the contact body 3 comprises a bevelled segment 22 placed, in a radial direction Y, to the exterior of the contact surface 8.

This shape makes it possible to avoid a mechanical contact between the contact bodies 3, 31 on their periphery. In case of welding of the contact bodies together in regions in which an electric arc is created, the moment exerted by the force intended to separate the contacts is lower than if a weld were present on the periphery of the contact body. The risk of plastic deformation of the contact is limited.

The bevelled segment 22 makes with the longitudinal axis X an angle A4 comprised between 80° and 89°.

The contact body 3 comprises an angular positioning hole 23 and the rod 2 comprises an angular positioning pin 24, the pin 24 being inserted into the angular positioning hole 23.

The invention claimed is:

1. An electrical breaking contact for a medium-voltage vacuum interrupter, the contact comprising:

a rod extending along a longitudinal axis, said rod being configured to be passed through by an electrical current, a contact body extending transversely to the longitudinal axis and comprising a first fastening surface, the contact body and the rod being coaxial, wherein the rod comprises:

a second fastening surface securely fastened to the first fastening surface, an abutment surface radially exterior to the second fastening surface, the abutment surface being distant from the contact body along the longitudinal axis and turned toward the contact body, wherein the contact body and the abutment surface are configured so that one segment of the contact body makes contact with the abutment surface during a flexion of the contact body.

2. The electrical breaking contact according to claim 1, wherein a distance, measured in a direction parallel to the longitudinal axis, between the abutment surface and the contact body, is comprised between 0.2 millimetres and 1.0 millimetres.

3. The electrical breaking contact according to claim 1, wherein the abutment surface comprises a plurality of abutment regions that are distant from one another.

4. The electrical breaking contact according to claim 1, wherein the rod comprises a groove adjacent to the second fastening surface.

5. The electrical breaking contact according to claim 1, wherein the contact body comprises a contact surface configured to make contact with a second electrical breaking contact placed facing the contact, so as to allow the electrical current to pass between the contact and the second electrical breaking contact, wherein the first fastening surface extends radially between a first internal distance and a first external distance, and the contact surface extends radially between a second internal distance and a second external distance and wherein a ratio between the second internal distance and the first external distance is higher than or equal to 1.

6. The electrical breaking contact according to claim 5, wherein the abutment surface is plumb with the contact surface in a direction parallel to the longitudinal axis.

7. The electrical breaking contact according to claim 5, wherein the contact surface comprises a plurality of contact regions that are distant from one another.

8. The electrical breaking contact according to claim 7, wherein the abutment surface comprises a plurality of abutment regions that are distant from one another, and wherein each abutment region is located plumb with a contact region of the plurality of contact regions in a direction parallel to the longitudinal axis.

9. The electrical breaking contact according to claim 5, wherein the contact body comprises a bevelled segment placed, in a radial direction, to an exterior of the contact surface.

10. The electrical breaking contact according to claim 1, wherein the contact body has a spiral configuration, the contact body having a disc shape comprising slits passing through a thickness of the disc, the slits extending from a periphery of the contact body toward an interior of the contact body.

11. A vacuum interrupter comprising a fixed contact and a movable contact each contact being the electrical breaking contact according to claim 1, the movable contact being movable between a position of contact with the fixed contact allowing a passage of electrical current and a position distant from the fixed contact preventing a passage of current.

12. A breaking device comprising the vacuum interrupter according to claim 11.

13. The electrical breaking contact according to claim 1, wherein the electrical breaking contact is a radial-magnetic-field electrical breaking contact.

* * * * *